United States Patent [19]

Stoger et al.

[11] 4,176,034

[45] Nov. 27, 1979

[54] APPARATUS FOR THE ELECTRODEPOSITION OF ALUMINUM

[75] Inventors: Klaus Stoger; Richard Dotzer, both of Nuremburg; Josef Stadter, Erlangen; Johann Gehring, Spardorf, all of Fed. Rep. of Germany

[73] Assignee: Siemens Aktiengesellschaft, Munich, Fed. Rep. of Germany

[21] Appl. No.: 896,378

[22] Filed: Apr. 14, 1978

[30] Foreign Application Priority Data

Apr. 15, 1977 [DE] Fed. Rep. of Germany ..... 2716805

[51] Int. Cl.[2] ..... C25D 3/44; C25D 5/34

[52] U.S. Cl. ..... 204/200; 204/199; 204/212

[58] Field of Search ..... 204/199, 200, 212, 215

[56] References Cited

U.S. PATENT DOCUMENTS

| | | | |
|---|---|---|---|
| 2,085,730 | 7/1937 | Cox et al. | 204/200 |
| 2,326,707 | 8/1943 | Thomas et al. | 204/199 |
| 2,448,116 | 8/1948 | Pearson et al. | 204/200 |
| 4,003,805 | 1/1977 | Schaer et al. | 204/199 X |
| 4,036,725 | 7/1977 | Allen et al. | 204/199 X |

*Primary Examiner*—Arthur C. Prescott

*Attorney, Agent, or Firm*—Kenyon & Kenyon

[57] ABSTRACT

Above the electroplating trough, a lock chamber is arranged which can be flooded with protective gas and is subdivided by means of an intermediate door into an outer chamber and a main chamber. The outer chamber has an outer lock door while the main chamber is connected to the electroplating trough by an inner lock opening. In addition, a work piece transfer device is provided which can be moved between the outer chamber and the main chamber and can be operated from the outside.

14 Claims, 4 Drawing Figures

APPARATUS FOR THE ELECTRODEPOSITION OF ALUMINUM

Figure 1:
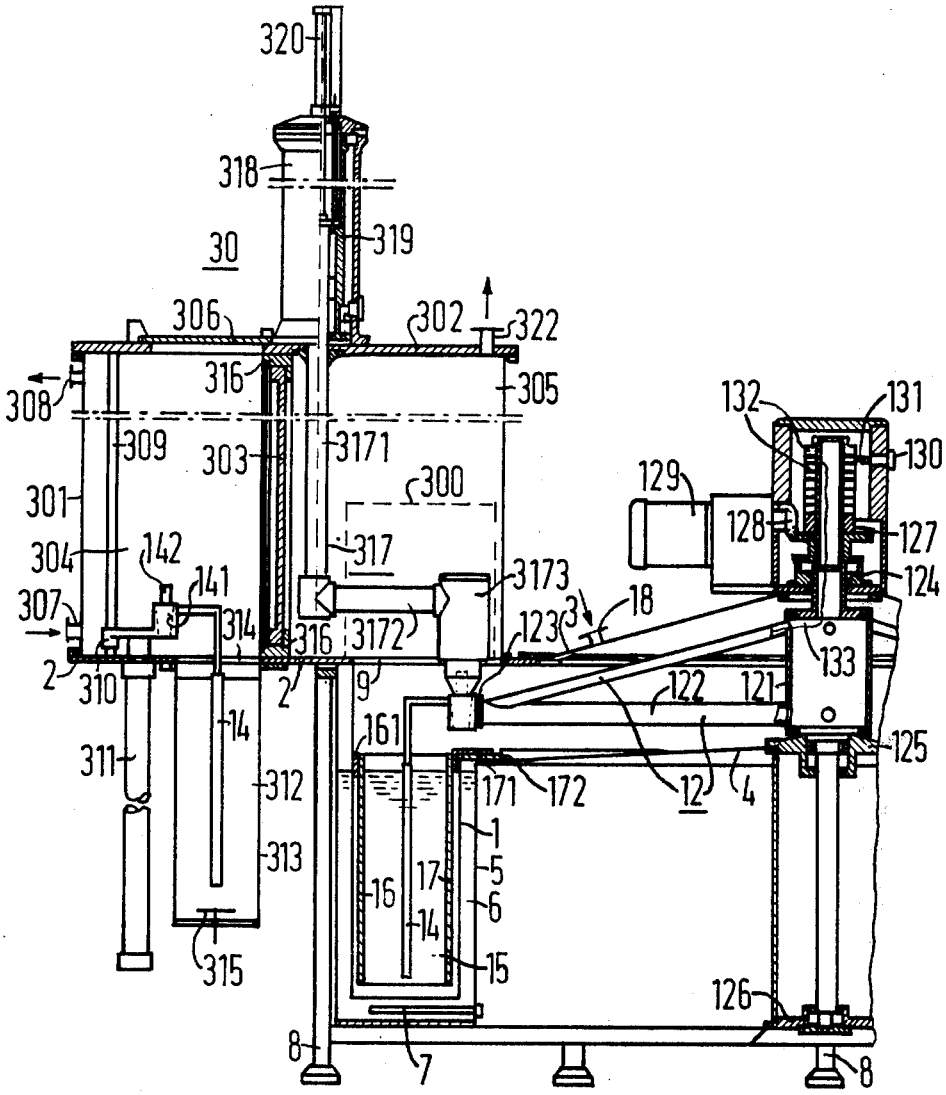

The invention relates to apparatus for the electrodeposition of aluminum from aprotic, oxygen- and water-free, organo-aluminum electrolytes, comprising an electroplating trough which is closed off to the outside and to which protective gas can be admitted; a contact and mounting device arranged within the electroplating trough; and a lock chamber which can be flooded with protective gas and in which a work piece transfer device is arranged which can be operated from the outside.

Aluminum electrodeposited from aprotic, oxygen- and water-free organo-aluminum electrolytes has been found to be particularly suitable for many engineering purposes due to its ductility, lack of porosity, corrosion resistance and ability to be anodized. Such electrolytes, which are known, for instance, from U.S. Pat. Nos. 3,448,127 or 3,418,216, are prepared and kept under oxygen- and water-free conditions. Since the access of air causes a considerable reduction of the conductivity and the life of these electrolytes due to reaction with air oxygen and air moisture, air must be kept away from the electrolytic bath during the electroplating of aluminum. This exclusion of air is made possible, according to the German Offenlegungsschrift No. 2,537,256, by apparatus of the afore-mentioned type, in which the lock chamber is connected to the electroplating trough via an inner lock door. The work pieces to be electroplated are brought into the lock chamber through an outer lock door, whereupon the outer lock door is closed and the lock chamber is flooded with a protective gas. After the ambient air which entered when the work pieces were inserted, is displaced again by the protective gas, the inner lock door is opened, so that the work pieces can be transferred by means of the work piece transfer device to the contact and mounting device in the electroplating trough. After the aluminum is electrodeposited, the work pieces are again brought into the lock chamber and removed through the outer lock door, with the inner lock door closed. This lock concept ensures long life of the electrolyte especially in electroplating apparatus on a laboratory scale. From a certain size of the facility on, however, reactable molecules which have remained in the lock chamber, can lead to a reduction of the conductivity and shorter life.

It is an object of the present invention to further improve the apparatus described above, so that it can be used particularly for aluminum plating with the scope of a technical production facility.

According to the invention, this problem is solved by the provision that in apparatus of the type mentioned at the outset, the lock chamber is subdivided by means of an intermediate door into an outer chamber with an outer lock door and a main chamber which is connected by an opening to the electroplating trough, and that a work piece transfer device is provided which can be moved between the outer chamber and the main chamber if the intermediate door is open. The work pieces to be electroplated are first placed in the outer chamber, whereupon the outer lock door is closed and the outer chamber is flooded with protective gas. After the intermediate door is opened, the work pieces are then brought into the main chamber by means of the work piece transfer device, whereupon the intermediate door can be reclosed immediately. The transfer of the work pieces to the contact and holding device in the electroplating trough is likewise accomplished by means of the work piece transfer device. After being electroplated, the work pieces are then brought into the outer chamber via the main chamber and are removed from the outer chamber with the intermediate door closed. With this lock concept, degradation of the electrolyte by reactable molecules which have remained in the lock chamber, can be reduced further. By opening the intermediate door, the volume of the lock chamber is thus increased and the concentration of the reactable molecules which have not been displaced completely by the flooding with protective gas is reduced. In addition, the intermediate door is open only during the short time when the work pieces are moved between the outer chamber and the main chamber, whereby the diffusion of reactable molecules from the outer chamber into the main chamber and the electroplating trough is reduced further.

In a preferred embodiment of the apparatus according to the invention a tank for receiving a rinsing liquid is arranged within the outer chamber. The work pieces, which have been pretreated to create bare and cover-layer-free surfaces, can thereby be immersed in the rinsing liquid during the flooding of the outer chamber, so that possible new corrosion or precipitation of a moisture film is precluded with certainty. The rinsing liquid therefore provides additional protection of the work pieces during the flooding with protective gas and thereby brings about a further increase of the adhesion of the aluminum layer which is electrodeposited later. If an ultrasound source for insonification of the rinsing liquid is associated with the tank, then an optimum surface pretreatment is obtained for the work pieces. The work pieces can be immersed in the rinsing liquid in a particularly simple manner by a work piece immersing device which is arranged in the outer chamber, can be operated from the outside and moved in the vertical direction.

Preferably, a work piece transfer device is provided which can be moved in the vertical direction and can be swung between the outer chamber and the main chamber. The work pieces can be transported between the outer chamber and the main chamber rapidly by a simple swinging motion, while the vertical adjustibility makes possible the transfer to the contact and holding device.

A sliding door is advantageously provided as the intermediate door. Such a sliding door can be operated very simply if compared to lids or shutters and also does not lead to a reduction of the usable space of the outer chamber or the main chamber.

A further preferred embodiment of the apparatus according to the invention is characterized by the feature that the electroplating trough has a toroidally closed electrolyte tank; that a contact and holding device is provided which can be rotated about a vertical axis; and that above the electroplating trough, a second, substantially similar lock chamber is arranged, the first lock chamber forming a charging lock and the second lock chamber, a discharging lock. Because the electrolyte tank of the electroplating trough is of ring-shaped design, the work pieces can be moved through the electrolyte on a circular path via the contact and holding device and be coated with aluminum at higher current densities. The ring-shaped design of the electrolyte tank further makes possible the physical separation of charging and removing the work pieces by means of the charging lock and the discharging lock. With this design, further advantages are obtained due to the fact that the contact and holding device has at least two support arms and that the arrangement of the charging lock and the discharging lock is matched to the pitch of the support arms. The different support arms can be supplied with current separately, so that different deposition conditions can be set for different work pieces. The individual support arms can furthermore be loaded and unloaded simultaneously and cyclically without much interruption.

In another preferred embodiment, a tank for receiving a pretreatment bath is arranged in the outer chamber of the charging lock and a tank for receiving a post-treatment bath in the outer chamber of the discharging lock. Thereby, the pretreatment and the post-treatment of the work pieces is included in the lock area acted upon by protective gas of the electroplating facility, which increases the efficiency, quality and safety of the electroplating of aluminum further.

It is advantageous to arrange in the main chamber of the discharging lock a spraying device for spraying a solvent compatible with the electrolyte. By means of this spraying device, the finished electroplated work pieces can be freed of adhering electrolyte residue in the main chamber of the discharging lock. As the electrolyte residue returns into the electroplating trough, the electrolyte is dragged out very little. In addition, the work pieces are cleaned by the spraying and are already cooled off, which increases the safety in the further handling of the work pieces. If the spraying device is connected to a condensing device which is in communication with the electroplating trough, a closed loop of the solvent and constant solvent concentration in the electrolyte are made possible. The cooling surface of the condensing device is advantageously formed by the inclined wall of an upper terminating hood of the electroplating trough.

To simplify servicing, an opening which can be closed is provided between the main chamber and the electroplating trough. This closure, which is not necessary for the operation of the electroplating facility, is shut for maintenance work on the lock chamber, so that there can be no adverse effect on the electrolyte.

For actuating the parts that can be operated from the outside, preferably pneumatic or hydraulic drive means are provided. Such drive means are extremely reliable and, as far as flammability of gaseous or liquid solvents is concerned, serve to further increase the operating safety.

Figure 2:
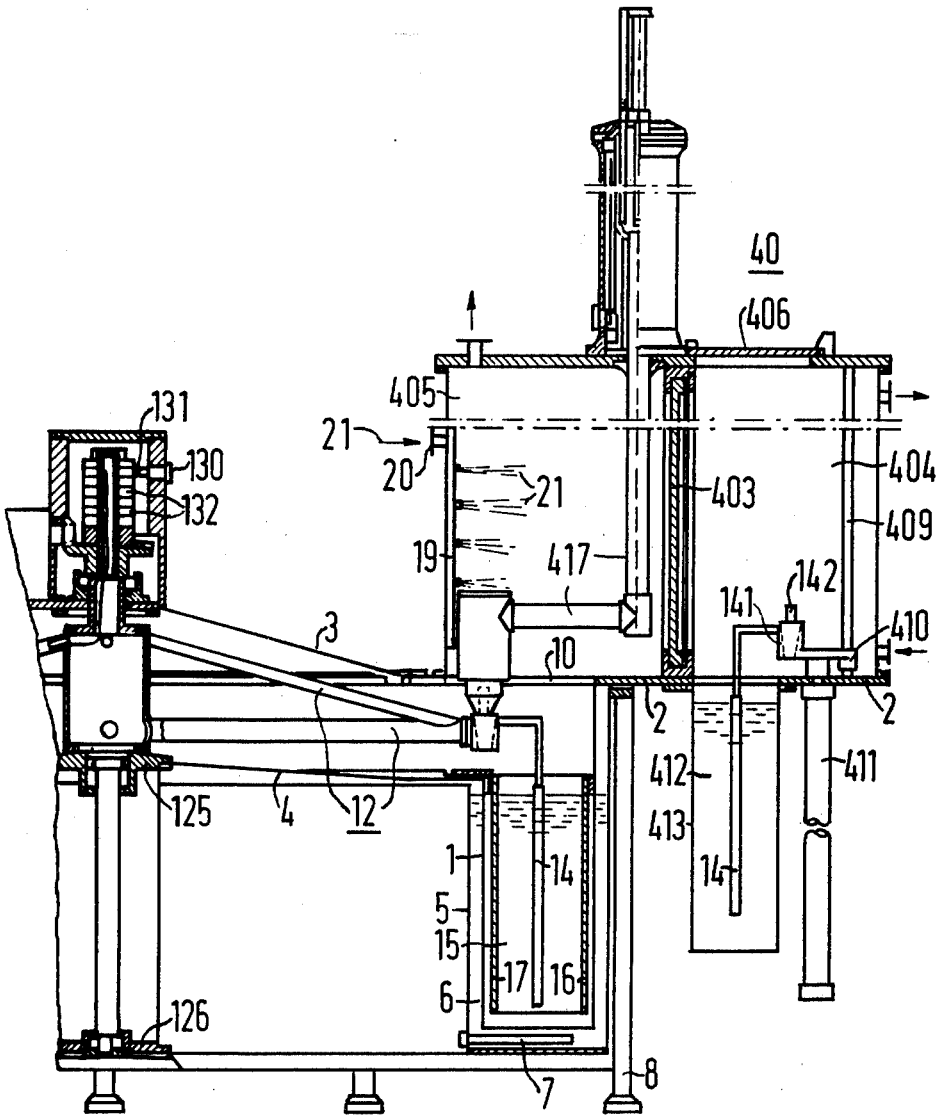
Figure 3:
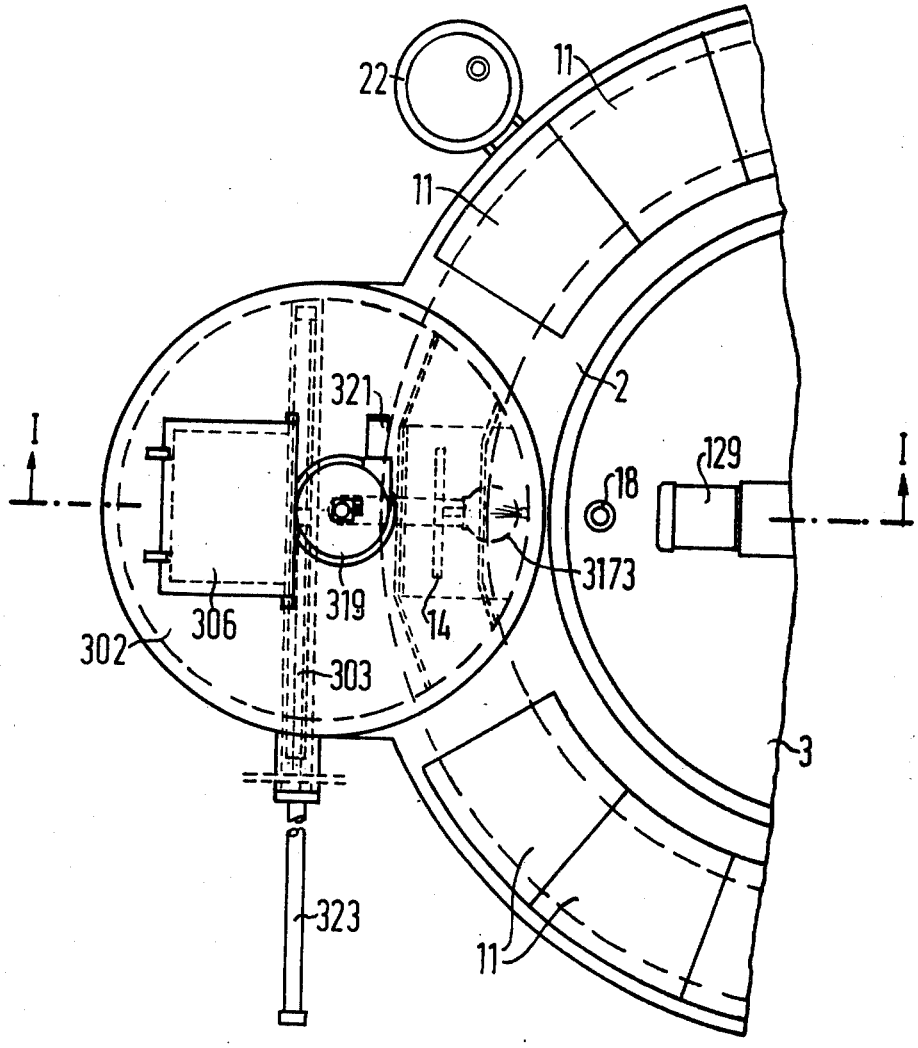

An embodiment example of the invention will be explained in greater detail in the following, referring to the drawing, where FIG. 1 shows a first partial view of a vertical section through the electroplating apparatus according to the invention, FIG. 2, a second partial view of the vertical section, complementing FIG. 1, FIG. 3, a top view onto the partial area of the electroplating apparatus shown in FIG. 1, and FIG. 4, a possible design of a condensing device.

The electroplating trough of the apparatus shown consists of an electrolyte tank 1 of toroidal shape and symmetry of revolution; an upper terminating cover 2; an upper terminating hood 3 and a lower terminating hood 4. The electrolyte tank 1 is suspended in a heating tank 5 which is likewise of toroidal design and symmetry of revolution and serves to receive a heating bath 6, e.g., an oil bath. The heating bath 6 can be heated, as in the case shown, via heating cartridges 7 or by connecting a circulating heater. The electrolyte tank 1 and the heating tank 5 are hung together in a frame 8 which gives the entire apparatus the necessary static stability. To the cylindrical outer wall of the electrolyte tank 1 is flanged the substantially annular upper closing cover 2 which, in turn is connected to the upper terminating hood 3. The upper closing cover 2 has two inner lock openings 9 and 10 which are arranged on opposite sides and will be described later on. Further openings distributed over the circumference of the upper closing cover 2 are closed off by detachable cover segments 11, as can be seen in the top view of FIG. 3. To the cylindrical inner wall of the electrolyte tank 1, which has a lower height than the outer wall, the lower terminating hood 4 is flanged. By the different heights of the outer wall and the inner wall of the electrolyte tank 1, an empty space is created in the electroplating trough between the upper closing cover 2 and the upper terminating hood 3 on the one hand and the lower terminating hood 4, on the other hand. This empty space is provided for accommodating a contact and holding device 12, which is designated overall with 12. The contact and holding device 12 consists of a rotor 121 which comprises a total of eight support arms 122 with receptacles 123, arranged at equal angular spacing. The shaft of the rotor 121 which is aligned centered with respect to the electrolyte tank 1, is rotatably supported by means of two gastight flange bearings 124 and 125 and is supported below by a thrust bearing 126 connected to the frame 8. The flange bearing 124 is flanged to the upper terminating hood 3, while the flange bearing 125 is flanged to the lower terminating hood 4. The rotor 121 is driven above the upper terminating hood 3 via miter gears 127 and 128 and a reduction motor 129 which is of explosion-proof design. Each one of the eight support arms 122 has a separate cathode connection 130; only the cathode connection 130 for the support arm 122 lying in the section plane of FIG. 1 is shown in the drawing. The cathode terminals 130 are connected to the corresponding receptacles 123 via carbon brushes 131, slip rings 132 placed on the rotor shaft and leads 133, which are brought through support tubes, not specifically designated, of the support arms 122. Locating the drive and the current suppy of the contact and holding device 12 in the region above the electroplating trough makes possible very good accessibility for maintenance work, as is necessary from time to time for checking the carbon brushes 131, for instance.

The receptacles 123 arranged at the outer ends of the support arms 122 have conical receiving holes, into which correspondingly shaped cones 141 of work piece holders 14 can be hung. The conical shape aids the current transfer between the receptacles 123 and the work piece holders. The work piece holders 14 have a frame which, in the view of FIGS. 1 and 2, is arranged perpendicularly to the section plane and in which the work pieces to be aluminum-plated are fastened, for instance, by means of electrically conducting holding wires. The work pieces can therefore be led by the rotary motion of the contact and holding device 12 on a circular path of revolution through an electrolyte 15 contained in the electrolyte tank 1. At equal spacings from the revolving path of the work piece holders 14, outer anode segments 16 are arranged in an outer ring and inner anode segments 17 in an inner ring. The outer anode segments 16 are fastened to the outer wall of the electrolyte tank 1 via insulating spacers 161, while the inner anode segments 17 are fastened to the lower terminating hood 4 via angle brackets 171 and insulating spacers 172. The current supply, not shown in detail in the drawing, to the outer anode segments 16 and the inner anode segmants 17 is accomplished in a manner customary in electroplating, for instance, via cables which are brought through the walls of the electrolyte tank 1 and the heating tank 5 by means of electrically insulated seals. The detachable cover segments 11 mentioned already earlier, of the upper cover plate 2 allow quick replacement of the anode segments 16 and 17 and to change the anode spacing.

To protect the oxygen- and water-free organoaluminum electrolyte 15, a dry protective gas is admitted to the electroplating trough; this gas is fed in, for instance, via a connection 18 arranged at the upper terminating hood 3 and is dosed in such a manner that it is always under slight overpressure. In this manner, the electroplating trough forms a space sealed against the outside, to which protective gas is admitted and which allows the insertion and removal of the work pieces fastened to the work piece holders 14 only through the two inner lock openings 9 and 10 already mentioned earlier. So that no ambient air can penetrate into the electroplating trough at these points either, a charging lock 30 is arranged above the inner lock opening 9 and a discharging lock 40 above the inner lock opening 10.

The charging lock 30 consists of a circular-cylinder shell 301, which is flanged with its underside to the upper closing cover 2 and which is closed off toward the top by a flanged-on cover plate 302. By means of an intermediate door 303, designed as a sliding door, the interior of the charging lock 30 is subdivided into an outer chamber 304 and a main chamber 305. The outer chamber 304 is accessible from the outside through an outer lock door 306 which is designed as a closable lid, and can be flooded with dry protective gas via an inlet nozzle 307 and a discharge nozzle 308. The work piece holders 14 brought into the outer chamber 304 through the outer lock door 306 are transferred there to a work piece immersing device. This work piece immersing device consists of a fixed and vertically aligned guide rod 309, a receptacle 310 and a pneumatic cylinder 311. The pneumatic cylinder 311 is arranged underneath the outer chamber 304; its actuating rod is brought through the upper closing cover 2 and is connected to the receptacle 310. For picking up a work piece holder 14, the receptacle 310 has a conical hole into which the cone 141 can be hung. The hanging is accomplished, for instance, via a charging rod not shown in the drawing, which can be detachably connected to the pickup pin 142 of the work piece holder 14. After it is hung, the work piece holder 14 can be lowered into a pretreatment bath 312 by actuating the pneumatic cylinder 311. This pretreatment bath 312 is contained in a tank 313 which is flanged to the upper closing cover 2 from below and is in communication with the outer chamber 304 via an opening 314. For pretreatment of the work pieces using ultrasound, the tank 313 is equipped with an ultrasound source 315, which is merely indicated in the drawing.

The sliding door 303, which can be closed gastight, is guided in a U-shaped frame 316 and can be opened and closed by means of a pneumatic cylinder 317 which is arranged outside the shell 301.

The main chamber 305 is connected continuously to the electroplating trough via the inner lock opening 9 when the apparatus is in operation. Only for maintenance work on the charging lock 30, a lid is provided which can be closed and is indicated in the drawing by dot-dashed lines 300. Inside the main chamber 305, a work piece transfer device 317 is arranged which consists substantially of a vertical lifting and turning rod 3171, a lever arm 3172 vertically branching off therefrom and a coupler 3173 attached to the outer end thereof. The coupler 3173 is designed so that it can be coupled detachably to the pickup pin 142 of a work piece holder 14, the engaging and disengaging being controllable from the outside. This can be done, for instance, by switching on and off an electromagnet mounted in the coupler 3173. The lifting and turning rod 3171 is brought through the cover plate 302 gastight at the top and supported in a bearing housing 318. This bearing housing 318, which is firmly flanged to the cover plate, has a rotatable inner cylinder 319, in which the lifting and turning rod 3171 is supported secured against rotation but vertically movably. The vertical displacement, i.e., the raising and lowering of the work piece transfer device 317 is accomplished by a pneumatic cylinder 320 which is mounted on the bearing housing 318. With the sliding door 303 open, the work piece transfer device 317 can also be swung back and forth between the outer chamber 304 and the main chamber 305. For this purpose, a positioning motor 321 of explosion-proof design is provided which can turn the inner cylinder 319 and thereby, the lifting and turning rod 3171, via a worm and worm gear.

For flooding the main chamber 305 with a dry protective gas, which must be done particularly if the apparatus is started up or re-started, a discharge nozzle 322, through which the protective gas fed-in via the connection 18 and the electroplating trough can be discharged, is provided in the cover plate 302.

The discharging lock 40 is of similar design as the charging lock 30. It is subdivided by a sliding door 403 into an outer chamber 404 and a main chamber 405; the outer chamber 404 has an outer lock door 406 for taking out the finished electroplated work pieces, and the main chamber 405 is connected to the electroplating trough via the inner lock opening 10. In the space of the outer chamber 404 is included a post-treatment bath 412 which is contained in a tank 413. The work piece immersing device arranged in the outer chamber 404 consists of a guide rod 409, a receptacle 410 and a pneumatic cylinder 411. In the main chamber 405, a work piece transfer device 417 is arranged which corresponds to the work piece transfer device 317 and is operated in the same manner. Also the other, not sepcifically designated parts of the discharging lock 40 correspond to the already described parts of the charging lock 30, but an ultrasound source for the post-treatment bath 412 is not required. Contrary to the charging lock 30, a spraying device 19 is arranged in the main chamber 405 of the discharging lock 40, by which a solvent 21 fed-in via a nozzle 20 can be sprayed. This solvent 21 frees the aluminum-plated work pieces which are fastened to the work piece holder 14 and are brought into the outer chamber 5 by means of the work piece transfer device 417, of adhering residue of the electrolyte 15. The solvent 21 then drips, together with the rinsed-off electrolyte 15, into the electroplating trough through the inner lock opening 10. So that the concentration of the solvent 21 in the electrolyte 15 can be kept constant in order to assure constant deposition conditions, an intensive evaporator 22 is provided, through which the electrolyte 15 is pumped in circulation with the electroplating trough. The solvent evaporated from the electrolyte 15 by the intensive evaporator 22 is then condensed in an associated condensing device and fed back to the spraying device 19, so that a closed circuit for the solvent 21 is created.

Figure 4:
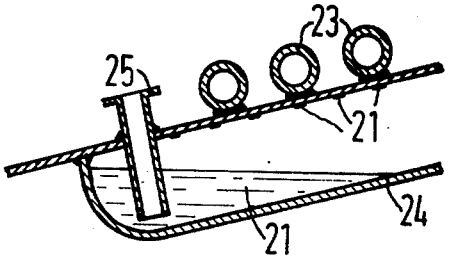

Another concept for obtaining a closed circuit for the solvent 21 is shown in FIG. 4. Accordingly, cooling tubes 23 carrying a coolant are arranged on the outside of the inclined upper terminating hood 3. The solvent 21 evaporating at the operating temperatures of the electrolyte 15, which are between 90° and 105° C., is condensed at the cooled surface of the upper terminating hood 3 and is collected in a collecting tray 24. From this collecting tray 24, the condensed solvent 21 can then be returned to the spraying device 19 via an immersed tube 25 which leads to the outside.

As already mentioned, the above-described electroplating apparatus is designed for use in a technical production facility. The filling volume of the electrolyte 15 is about 830 liters and the filling volume of the heating bath 6 about 330 liters. To given an idea of the size, the maximum height of the apparatus is 4.15 m and the maximum width 3.64 m. The diameter of the path of revolution described by the work pieces in the electrolyte tank 1 is 2.0 m.

The choice of materials for the apparatus described is not critical, since there is no danger of corrosion because of the complete absence of oxygen and water. Thus, the electrolyte tank 1 can consist, for instance, of enamelled sheet steel. The outer and inner anode segments 16 and 17 consist of aluminum. As the protective gas for admitting to the electroplating trough and for flooding the charging lock 30 and the discharging lock 40, respectively, nitrogen is used preferably. However, helium, argon krypton or gaseous hydrocarbons can be used as the protective gas. Toluol is preferably used for the pretreatment bath 312 and the post-treatment bath 412. However, other aromatic hydrocarbons such a xylol are also suitable. However, separate supply tanks are preferably chosen for the pretreatment bath 312 and the post-treatment bath 412, so that no intermixing can take place and the pretreatment bath 312 can be kept absolutely clean. Toluol is also used for spraying the work pieces via the spraying device 19.

Before the work pieces to be electroplated are placed in the apparatus described, they can be subjected to a pretreatment to create bare and cover-layer-free surfaces, as is known, for instance, from U.S. Pat. No. 3,972,784. The subsequent aluminum plating includes the following steps, in a preferred mode of operation:

(a) the work pieces fastened to a work piece holder 14 are placed in the outer chamber 304 of the charging lock 30, are immersed in the pretreatment bath 312 and are cleaned, using ultrasound, (b) with the outer lock door 306 closed, the outer chamber 304 is flooded with a protective gas while the work pieces are immersed in the pretreatment bath 312, (c) the sliding door 303 is opened, the work piece holder 14 is coupled to the work piece transfer device 317 and swung into the main chamber 305, (d) the sliding door 303 is closed and the work piece holder 14 is transferred to the contact and holding device 12, (e) the work pieces are aluminum electroplated while the contact and holding device 12 rotates, (f) the work piece holder 14 is coupled to the work piece transfer device 417 and brought into the main chamber 405 of the discharging lock 40, (g) the work pieces are sprayed off by means of the spraying device 19, (h) the sliding door 403 is opened, the work piece transfer device 417 is swung into the outer chamber 404 and the work piece holder 14 transferred to the receptacle 410 of the immersing device, (i) the work piece transfer device 417 is swung into the main chamber 405, the sliding door 403 is closed and the work piece holder 14 is immersed in the post-treatment bath 412, (j) the work piece holder 14 is lifted out of the post-treatment bath 412 and is taken from the outer chamber 404, with the outer lock door 406 open.

The process steps listed above refer to the passing-through of a given work piece holder 14. For different work pieces, the steps (a) to (d) and (f) to (j) can be performed at the same time, since the charging lock 30 and the discharging lock 40 are physically separated from each other.

We claim:

1. Apparatus for the electrodeposition of aluminum from aprotic, oxygen- and water-free, organo-aluminum electrolytes, comprising an electroplating trough which is closed to the outside and to which a protective gas can be admitted; a contact and holding device arranged within the electroplating trough; and a lock chamber which is arranged above the electroplating trough, can be flooded with protective gas and in which a work piece transfer device is arranged which can be operated from the outside, characterized by the feature that the lock chamber (30, 40) is subdivided by means of an intermediate door (303, 403) into an outer chamber (304, 404) with an outer lock door (306, 406) and a main chamber (305, 405) which is connected to the electroplating trough (1, 2, 3, 4) by an opening (9, 10), and that a work piece transfer device (317, 417) is provided which can be moved between the outer chamber (304, 404) and the main chamber (305, 405) if the intermediate door (303, 403) is open.

2. Apparatus according to claim 1, characterized by the feature that a tank (313, 413) for receiving a rinsing liquid (312, 412) is arranged within the outer chamber (304, 404).

3. Apparatus according to claim 2, characterized by the feature that an ultrasound source (315) for insonifying the rinsing liquid (312) is associated with the tank (313).

4. Apparatus according to claim 2, characterized by the feature that a work piece immersing device (309, 310, 311 and 409, 410, 411, respectively) which can be operated from the outside and can be moved in the vertical direction is arranged in the outer chamber (304, 404).

5. Apparatus according to claim 1, characterized by the feature that a work piece transfer device is provided which can be moved in the vertical direction and can be swung between the outer chamber (304, 404) and the main chamber (305, 405).

6. Apparatus according to claim 1, characterized by the feature that a sliding door is provided as the intermediate door (303, 403).

7. Apparatus according to claim 1, characterized by the feature that the electroplating trough (1, 2, 3, 4) has a toroidally closed electrolyte tank (1); that a contact and holding device (12) is provided which can be rotated about a vertical axis; and that above the electroplating trough (1, 2, 3, 4) a second lock chamber of substantially the same design is arranged, the first lock chamber (30) forming a charging lock and the second lock chamber (40) a discharging lock.

8. Apparatus according to claim 7, characterized by the feature that the contact and holding device (12) has at least two support arms (122) and that the arrangement of the charging lock (30) and the discharging lock (40) is matched to the pitch of the support arms (122).

9. Apparatus according to claim 7, characterized by the feature that a tank (313) for receiving a pretreatment bath (312) is arranged in the outer chamber (304) of the charging lock (30) and a tank (413) for receiving a post-treatment bath (412) is arranged in the outer chamber (404) of the discharging lock (40).

10. Apparatus according to one of the claim 7, characterized by the feature that a spraying device (19) for spraying a solvent (21) compatible with the electrolyte (15) is arranged in the main chamber (405).

11. Apparatus according to claim 10, characterized by the feature that the spraying device (19) is connected to a condensing device (22; or 23, 24 25, respectively) which is in communication with the electroplating trough (1, 2, 3, 4).

12. Apparatus according to claim 11, characterized by the feature that the inclined wall of an upper terminating hood (3) of the electroplating trough (1, 2, 3, 4) forms the cooling surface of the condensing device (23, 24, 25).

13. Apparatus according to claim 1, characterized by the feature that a closable opening (9, 10) is provided between the main chamber (305, 405) and the electroplating trough (1, 2, 3, 4).

14. Apparatus according to claim 1, characterized by the feature that pneumatic or hydraulic drive means (317, 311, 411, 320) are provided for the parts (303, 403, 310, 410, 317, 417) which can be operated from the outside.

* * * * *